US005230230A

United States Patent [19]

Horton

[11] Patent Number: 5,230,230

[45] Date of Patent: Jul. 27, 1993

[54] LOCK OPERATOR FOR INACTIVE MAGAZINE DOOR LOCKING BOLT SYSTEM

[75] Inventor: Craig Horton, Ventura, Calif.

[73] Assignee: The United States of America as represented by the Secretary of the Navy, Washington, D.C.

[21] Appl. No.: 878,341

[22] Filed: May 4, 1992

[51] Int. Cl.[5] ..... E05B 63/00

[52] U.S. Cl. ..... 70/1.5; 109/63.5; 292/150; 292/40; 74/110

[58] Field of Search ..... 70/1.5, 1.7, 416; 109/63.5; 292/106, 150, 207, 40; 403/315, 322; 74/110

[56] References Cited

U.S. PATENT DOCUMENTS

| | | | |
|---|---|---|---|
| 1,386,671 | 8/1921 | Zych | 292/207 |
| 1,622,608 | 3/1927 | Peterson | 70/1.7 |
| 1,638,204 | 8/1927 | Jones | 70/1.7 |
| 4,113,291 | 9/1978 | Cameron | 292/40 |
| 4,127,967 | 12/1978 | Franzl | 70/416 |
| 4,470,275 | 9/1984 | Fisher | 70/333 R |

FOREIGN PATENT DOCUMENTS

| | | |
|---|---|---|
| 1012115 | 12/1965 | United Kingdom . |
| 2249126 | 4/1992 | United Kingdom . |

*Primary Examiner*—Peter M. Cuomo
*Assistant Examiner*—Darnell M. Boucher
*Attorney, Agent, or Firm*—Ron Billi; Melvin J. Sliwka

[57] ABSTRACT

A lock operator located between a backing plate and sliding cover includes a pivot plate for activating and deactivating the main boltworks and a relocker, an overtravel stop assembly for sequestering the pivot plate to prevent relock, a spring braised knob for locking the pivot plate in the locked or unlocked position, a pin for locking the sliding cover, pivot plate and locking plate in the locked position and means for automatically activating/deactivating the overtravel stops assembly.

8 Claims, 3 Drawing Sheets

LOCK OPERATOR FOR INACTIVE MAGAZINE DOOR LOCKING BOLT SYSTEM

BACKGROUND OF THE INVENTION

This invention relates to safes, vaults, explosive magazine doors and the like security enclosures. More specifically, but without limitation, the present invention relates to a secondary locking apparatus, i.e. "lock operator", for activating/deactivating the main boltworks and relocker assembly and the mechanism that arms and renders inactive the relocking mechanism.

Magazine doors, which close off the entrance to the storage location of high explosives and other sensitive hardware are widely used in military applications. The magazine doors are designed to thwart attacks and are rated based on the time to obtain forcible entrance. One commonly used attack method is to drill, cut or otherwise penetrate the door exterior to render ineffective certain vital parts of the door locking mechanism which are provided to keep the main boltworks in the locked position. Reinforcing the doors in the vicinity of the locks with plates of hardened steel, drill resistant material or concrete encasement are common methods that have proved successful in increasing the time to gain entry.

Another successful method for increasing the entry time is a secondary locking method, commonly known as a relocker, that is triggered when an unauthorized entry is detected thereby "permanently" locking the primary locking apparatus. Once the relocker is triggered, the door may only be opened through extensive and time consuming manipulation inconsistent with undetected, forced entry.

It is desirable to incorporate both reinforcing and a relocker into door and locking mechanism. The more sensitive a relocker is in "detecting" unauthorized entry, the more effective it will be in thwarting attacks. However, a relocker must also be susceptible to deactivation upon command by authorized personnel so that entry beyond the door may be easily obtained without the relocker activating. It is therefore desirable that the relocker be extremely sensitive to thwart attacks but also include means for deactivation so that authorized personnel may open the door without the relocker being triggered.

Accordingly, it is the object of the present invention to provide a mechanism that may easily and quickly be activated to render a relocker inactive so that entry past a secure door may be obtained.

It is another object of the present invention to provide a mechanism that may be retrofitted to existing doors requiring high security type locks and relocker mechanisms.

It is a further object of the present invention to provide a mechanism that will allow a relocker assembly to be "set" in an extremely sensitive mode yet will render the relocker inactive when activated for authorized entry/exit.

It is still another object of the present invention to provide a mechanism that will automatically deactivate a relocker mechanism when the main locking mechanism of a secure door is unlocked.

It is still another object to provide a mechanism with the above features yet is inexpensive, simple and reliable.

SUMMARY OF THE INVENTION

Accordingly, the preferred embodiment of the present invention is located within a hollow door between a backing plate and a sliding cover and includes a pivot plate attached to the backing plate for activating the main boltworks and relocker assemblies; a sliding overtravel stops assembly for sequestering an end of the pivot plate to prevent overtravel of the pivot plate in either direction and the resultant triggering of the relocker; a removable pin for locking the sliding cover and pivot plate to the backing plate; a spring biased knob for locking the pivot plate in the closed or open position said spring biased knob only operable when said sliding cover is open; and means, communicating with the sliding cover and the overtravel stops assembly for activating the overtravel stops assembly when the sliding cover is open. The present invention requires an ordered sequence to activate and deactivate the lock mechanism.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
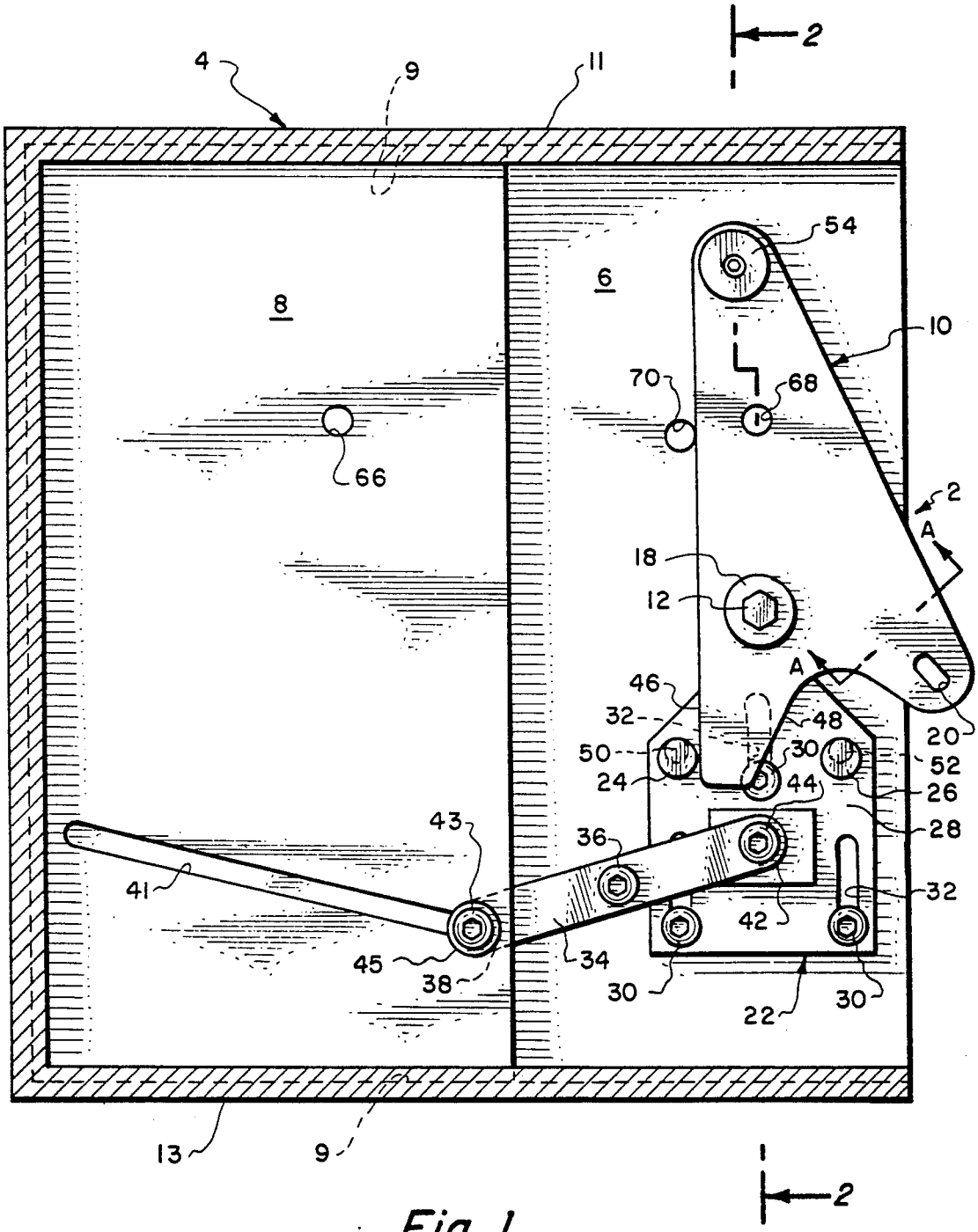
FIG. 1 is a side view of the present invention as viewed from the inside or access side of the mechanism with the sliding cover in the open position.
Figure 2:
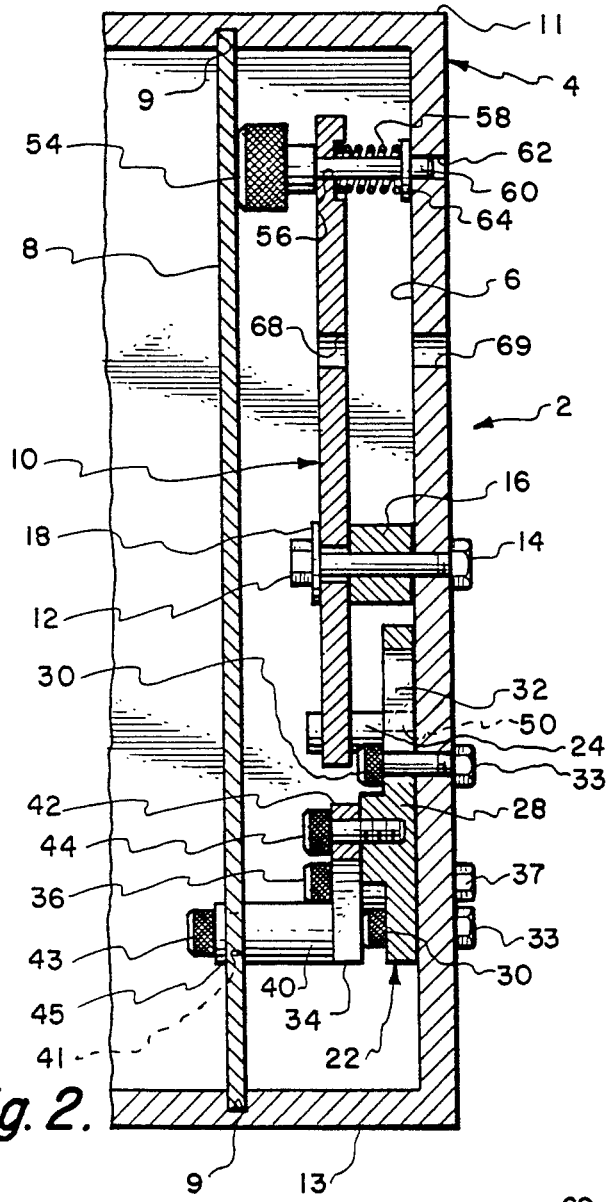
FIG. 2 is an end view of the present invention taken through section 2—2, of FIG. 1.
Figure 4:
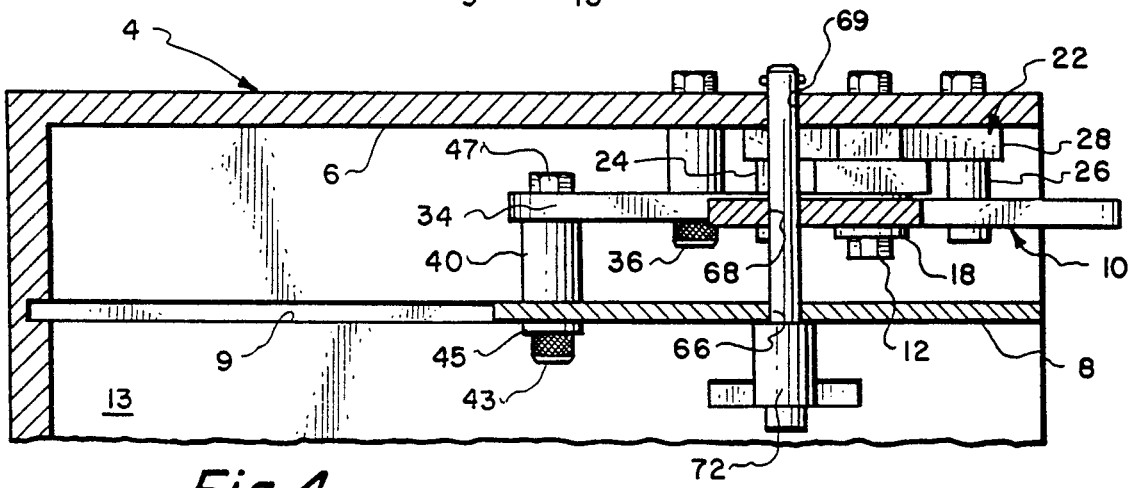
FIG. 4 is a side view of the present invention taken through section 4—4 of FIG. 3 with the sliding cover in the closed position.
Figure 3:
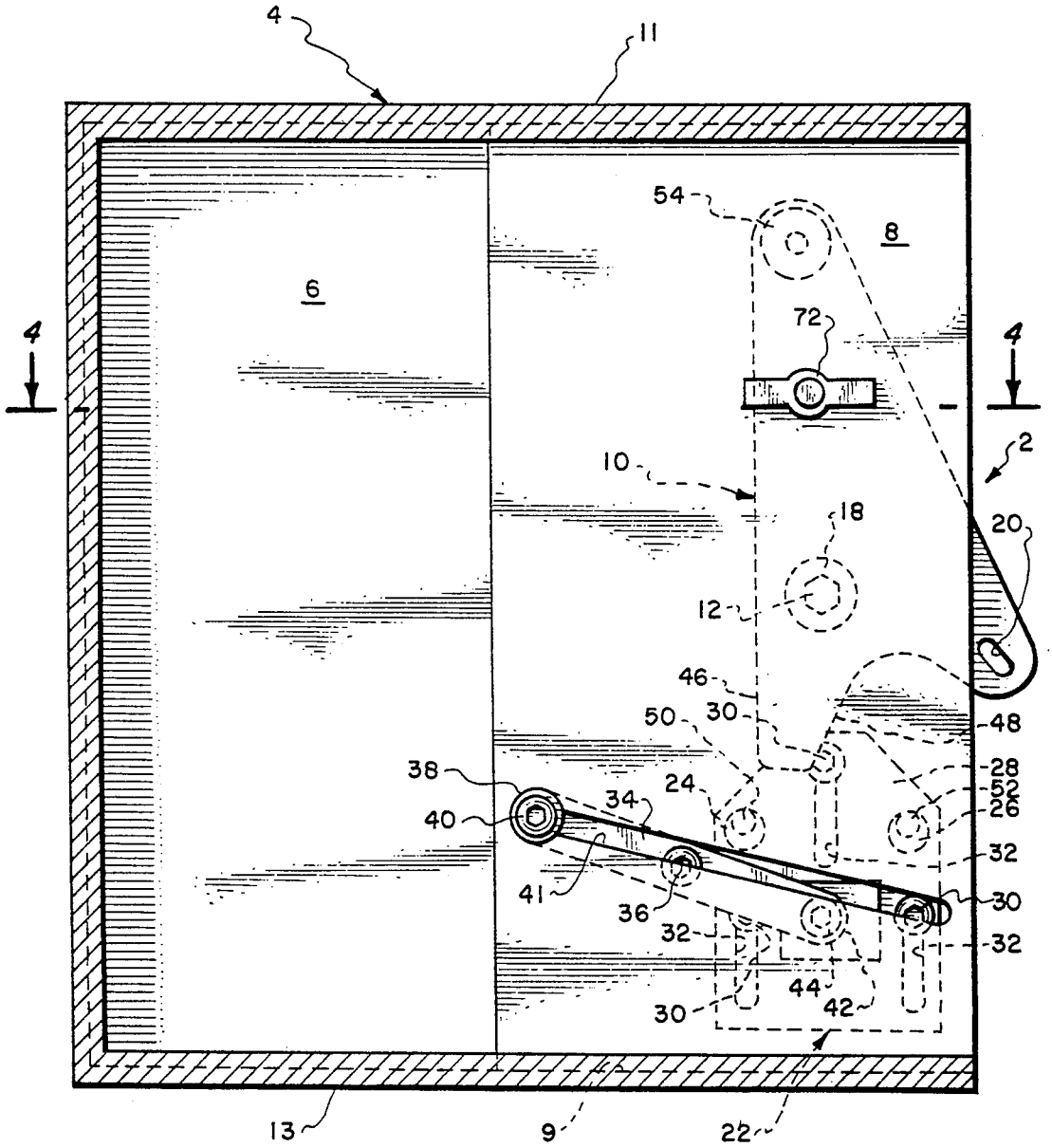
FIG. 3 is a top view of the present invention taken through section 3—3 of FIG. 1.

The preferred embodiment of the present invention is illustrated by way of example in FIGS. 1 to 4. As shown in FIG. 1, lock operator 2 is located in door 4 between backing plate 6 and sliding cover 8 and includes pivot plate 10 and overtravel stops assembly 22. Sliding cover 8 slides in grooves 9 (see FIG. 2) located in top and bottom plates 11 and 13 respectively. Pivot plate 10 is pivotally attached to backing plate 6 by bolt 12 and secured by locking nut 14 (see FIG. 2). Spacer 16 and washer 18 locate pivot plate 10 approximately 9/16 inches away from and approximately parallel to backing plate 6. Pivot plate 10 attaches to the main boltworks and relocker mechanism (not shown) via bore 20 and is in the locked position when pivoted clockwise and in the unlocked position when pivoted counterclockwise. As long as pivot plate 10 is pivoted to just lock or to just unlock the main boltworks (i.e. no overtravel in either direction) the relocker mechanism (not shown) will not be activated. However, when pivot plate 10 is pivoted beyond the distance necessary to just lock or just unlock the main boltworks, the relocker will be triggered. The distance pivot plate 10 must travel beyond the locked or unlocked position to activate the relock mechanism is called "overtravel".

Overtravel stops assembly (OTA) 22 includes first and second overtravel stops 24 and 26 eccentrically attached to slider 28. Slider 28 is slidably attached to backing plate 6 via bolts 30 in slots 32. Activating arm 34 is pivotally attached to backing plate 6 by bolt 36 and includes first end 38 slidably attached to sliding cover 8 by guide 40 located in slot 41 and second end 42 pivotally attached to slider 28 by pin 44. It can thus be seen that when sliding cover 8 is moved to the left in FIG. 1 (i.e. opened), first end 38 of activating arm 34 is caused to be pivoted counterclockwise about bolt 36 by the action of slot 41 on guide 40. As a result, second end 42 also pivots counterclockwise about bolt 36 causing slider 28 to travel upwards and sequester sides 46 and 48 of pivot plate 10 between overtravel stops 24 and 26 respectively. Accordingly, pivot plate 10 can only be pivoted between first overtravel stop 24 and second overtravel stop 26 and, when properly adjusted, will prevent pivot plate 10 from pivoting into overtravel and thereby triggering the relocker mechanism. First and second overtravel stops 24 and 26 include eccentrics 50 and 52 respectively and may be rotatably adjusted to precisely set the limits of travel of pivot plate 10.

Knob 54 is slidably located in bore 56 of pivot plate 10 and includes spring 58 is located between pivot plate 10 and shoulder 64. Knob 54 is normally biased in a direction towards backing plate 6 so that, when aligned, end 60 of knob 54 will communicate with locating bore 62 when in the locked position. Pivot plate 10 can only be pivoted out of the locked position after knob 54 is pulled to disengage end 60 from bore 62. However, knob 54 cannot be pulled unless sliding cover 8 is in the open position "uncovering" knob 54. It should be noted that once knob 54 is pulled and pivot plate 10 is pivoted out of the locked position, knob 54 remains pulled out which in turn prevents sliding cover from closing. Since sliding cover 8 cannot close, OSA 22 is activated and pivot plate 10 cannot go into overtravel. It can thus be seen that pivot plate 10 can only go into overtravel when sliding cover 8 is closed and knob 54 is in bore 62.

When sliding cover 8 is closed and pivot plate 10 is in the locked position (clockwise rotated in FIG. 1), bore 66 in sliding cover 8, bore 68 in pivot plate 10 and bore 69 in backing plate 6 are aligned and pin 72 slidably engages all 3 bores. Thus, pin 72 must be removed before sliding cover 8 and/or pivot plate 10 can be moved. In addition, pin 72 engages both bore 68 and bore 70 when pivot plate 10 is rotated counterclockwise into the open position thus locking pivot plate 10.

It can therefore be seen that in order to unlock the main boltworks (not shown), lock operator 2 must be taken through a sequence of steps: First, pin 72 must be removed to both unlock sliding cover 8 and partially unlock pivot plate 10. Second, sliding cover 8 must be moved to the open position by sliding to the left (as viewed in FIG. 1) wherein slider 28 is automatically moved upward sequestering sides 46 and 48 of pivot plate 10 between overtravel stops 24 and 26, respectively. This ensures that pivot plate 10, when rotated to the unlocked position, will not be overrotated sending the relocker mechanism (not shown) into relock. Third, knob 54 must be pulled, overcoming the spring induced bias to disengage end 60 from backing plate 6. While maintaining tension on knob 54, pivot plate 10 may be rotated counterclockwise (as view in FIG. 1) to disengage the main boltworks, without danger of overrotating into relock. Once rotated to the open position, pin 72 may be inserted into aligned bores 68 and 70 thereby locking pivot plate in unlocked position. Door 4 may now be opened. To lock the door the reverse procedure is employed.

It should be noted that any attempt to sever pivot plate 10 in the vicinity of line A—A (see FIG. 1) will result in relock since bore 20 must be very carefully controlled to prevent overtravel. In addition, relock results if overtravel is obtained in either direction. Overtravel stop assembly 22 allows the relock mechanism to be set to very close tolerances. For example, relock may be triggered if pivot plate 10 is rotated as much 1° over that required to lock/unlock the main boltworks.

In addition, knob 54 cannot be pulled or driven out until sliding cover 8 is slid to the open position to "uncover" knob 54. Further, sliding cover 8 cannot be opened without first removing pin 72. It should also be noted that lock operator 2 can only be opened from the inside, that is, from the sliding cover 8 side since door 4 is an "inactive" door.

By "inactive" is meant that no access to lock operator 2 is provided on the outside of door 4. Lock operator 2 must be operated from the inside or sliding cover 8 side.

Lock operator 2 may also be employed in either a right hand or left hand configuration. In addition many other modifications and variations of the present invention are possible in light of the above teaching. It is therefore to be understood that within the scope of the appended claims, the invention may be practiced otherwise than as specifically described.

What is claimed is:

1. A lock operator for activating the main boltworks and relocker mechanism of a security door comprising:
   a) a backing plate attached to the security door and having top and bottom plates attached thereto, the top and bottom plates including grooves therein;
   b) a pivot plate attached to the backing plate and communicating with the main boltworks and relocker mechanism, the pivot plate having an end extending therefrom;
   c) a sliding cover communicating with the grooves in said top and bottom plates and movable between an open and closed position, the sliding cover having a slot therein;
   d) means communicating with the slot for sequestering the end of said pivot plate to prevent said pivot plate from triggering said relocker when said sliding cover is open; and allowing said pivot plate to trigger said relocker when said sliding cover is closed.

2. The apparatus defined in claim I, further including means for locking said sliding cover, said pivot plate and said backing plate together when said sliding cover is closed.

3. The apparatus defined in claim 2, further including means for locking said pivot plate in the locked position.

4. The apparatus defined in claim 3, wherein said sequestering means includes a slider, slidably attached to said backing plate, first and second overtravel stops attached to either side of the slider, and an activating arm pivotally attached to said backing plate, the activating arm including a first and second end, the first end including a guide communicating with said slot in said sliding cover and the second end attached to said slider wherein said overtravel stops are caused to sequester said end of said pivot plate when said cover is moved to the open position.

5. The apparatus defined in claim 4, wherein said first and second overtravel stops include eccentrics for varying the distance between said first and said second overtravel stops.

6. The apparatus defined in claim 5, wherein the sliding cover, pivot plate and backing plate locking means includes bores located in said sliding cover, said pivot plate and said backing plate and a pin for simultaneously engaging said aligned bores.

7. The apparatus defined in claim 6, wherein the pivot plate locking means includes a bore located in said pivot plate, a bore located in said backing plate and a knob for simultaneously engaging the bore in said pivot plate and the bore in said backing plate, said knob only movable when said sliding cover is open.

8. The apparatus defined in claim 7, wherein said knob includes a spring that normally biases said knob in a direction towards said backing plate.

* * * * *